US007233243B2

(12) United States Patent
Roche et al.

(10) Patent No.: US 7,233,243 B2
(45) Date of Patent: Jun. 19, 2007

(54) METHOD OF DEFENSE-IN-DEPTH ULTRASOUND INTRUSION DETECTION

(75) Inventors: Robert Henry Roche, Westminster, MD (US); Vadym Buyalsky, Reisterstown, MD (US); Vladimir Herman, Montgomery Village, MD (US)

(73) Assignee: CTRL Systems, Inc., Westminster, MD (US)

( * ) Notice: Subject to any disclaimer, the term of this patent is extended or adjusted under 35 U.S.C. 154(b) by 71 days.

(21) Appl. No.: 10/754,800

(22) Filed: Jan. 9, 2004

(65) Prior Publication Data

US 2005/0151644 A1 Jul. 14, 2005

(51) Int. Cl.
*G08B 13/00* (2006.01)

(52) U.S. Cl. ..... 340/540; 340/565

(58) Field of Classification Search ..... 340/541, 340/541.1–541.3, 545.9, 555–561, 552–554, 340/566, 567, 565, 543.3, 551; 367/93
See application file for complete search history.

(56) References Cited

U.S. PATENT DOCUMENTS 4,319,332 A * 3/1982 Mehnert ..... 364/516
5,872,516 A * 2/1999 Bonge, Jr. ..... 340/573.3
6,127,926 A * 10/2000 Dando ..... 340/541
6,262,661 B1 * 7/2001 Mahler et al. ..... 340/567
6,346,705 B1 * 2/2002 Lee et al. ..... 250/353
6,411,202 B1 * 6/2002 Gal et al. ..... 340/425.5
6,885,303 B2 * 4/2005 Payton et al. ..... 340/565
6,922,145 B2 * 7/2005 Piesinger ..... 340/541
2004/0140886 A1 * 7/2004 Cleveland et al. ..... 340/431
2005/0040947 A1 * 2/2005 Buckley et al. ..... 340/567

* cited by examiner

*Primary Examiner*—Daniel Wu
*Assistant Examiner*—Jennifer Mehmood

(57) ABSTRACT

Method of ingress or egress intrusion detection by ultrasound surveillance throughout volumetric multi-area room around a protected object, where the surveyed room is arranged in juxtaposed volumetric closed or open areas that represent central, short-range and long-range echelons of defense-in-depth intrusion protection infrastructure. The used techniques of ultrasound intrusion detection are based on the phenomena of reflection, refraction by edge diffraction, and interference by shadowing of ultrasonic beams. The ultrasonic beam patterns are closely disposed in 2-D curvilinear or polygonal array, or in 3-D curved surface lattice over multilevel substantial openwork frames of different echelons. The informational and processing inter-echelon interrelation is being treated by control software algorithm that features situational logic transition driven by IF-THEN operator. The disclosed method shall enhance the distance of location, trustworthiness and cost-effectiveness of ultrasonic intrusion detection arrangements.

8 Claims, 9 Drawing Sheets

| Alternative sequences of detected signals in echelons | | | Versions of intrusion in eshelons | | | Versions of self-checking results | Notes |
|---|---|---|---|---|---|---|---|
| C | S | L | Ingress | Egress | Presence inside | | |
| C → C | | | | | + | May also mean an unauthorized discloser of protected housing. | Emitted ultrasound goes outside. |
| C → S | | | | + | | Target moves to echelon L ? Check it. | |
| S → C | | | + | | | Target moves from echelon L ? Check it. Echelon L may be in the failed state. | |
| C → L | | | | + | | Target moves inside echelon L ? Check it. Echelon S may be in the failed state. | |
| L → C | | | + | | | Target moves inside echelon C ? Check it. Echelon S may be in the failed state. | |
| | S → S | | | | + | Target moves in echelon S? Check it. Other echelons C and L may be in the failed state. | |
| | S → L | | | + | | Target moves from echelon C ? Check it. Echelon C may be in the failed state. | |
| | L → S | | + | | | Target moves to echelon C? Check it. Echelon C may be in the failed state. | |
| | | L → L | | | + | Target moves inside echelon L ? Check it. An intruder may not be threat if it passes by the echelon S. | |

Note: Arrows show the directional sequence of caution signals from intrusion-suspected echelons.

FIG. 3

| Sublevels of echelons (in indices of FIG.3) | $L_1$ | $L_2$ | $L_3$ | $L_4$ | $S_1$ | $S_2$ | $S_3$ | $S_4$ | $S_5$ | $C_1$ | $C_2$ | $C_3$ | Expected sequent events and real menaces at single intrusion |
|---|---|---|---|---|---|---|---|---|---|---|---|---|---|
| $L_1$ | X | | | | | | | | | | | | VAM, PO, OCF, CCF. |
| $L_2$ | | X | | | | | | | | | | | VAM, PO, OCF, CCF. |
| $L_3$ | | | X | | | | | | | | | | VAM, PO, OCF, CCF. |
| $L_4$ | | | | X | | | | | X | | | | VAM, PO, OCF, CCF. |
| $S_1$ | | | | | X | | | | | X | | | VAM, OCF. |
| $S_2$ | X | | | | | X | | | | | | | VAM, IF. |
| $S_3$ | | | | | X | | X | | | | | X | VAM, LF. |
| $S_4$ | | | | X | | | | X | | | | | VAM, CCF. |
| $S_5$ | | X | | | | X | | | X | | | | VAM, CCF. |
| $C_1$ | X | | X | | X | | X | X | | X | X | | VAM, SSF. |
| $C_2$ | | | | | | | | | | | X | | VAM, CCF. |
| $C_3$ | | | | | | | X | | | | | X | VAM, SSF, CCF. |
| **Expected sequent events and real menaces at multiple intrusion** | CCF | CCF | PO, DF | PO, DF | IF, DF | DF | DF, SSF | SSF CCF | LF, SCF | LF, DF | CCF | DF, PO | *The pre-designed samples of vulnerability of surveyed areas are being kept in archive data file.* |

FIG. 4

| Data Files of Operative Algorithm | Stages of System's Design and Operation | Data Record and Input Format | Data Processing Formats and Modes | Note |
|---|---|---|---|---|
| Predetermined Design Data | Design of multi-echelon arrangement of ultrasound detection system. Definition of its adjustment and starting-up basics. | Models of echelons' and entire protected area's intrusion vulnerability based on the presumptive models of intruders' run. | Optional spatio-temporal routings of intruders with cause-effect evaluation of vulnerability of facilities and the whole of object. | The size of each echelon is being rated in accordance with airborne ultrasound wave attenuation along its incidence-reflection trip. |
| Data batch entry under commissioning:<br><br>Data batch entry during operation: | Evaluation of cause-effect intrusion menaces and potential vulnerabilities.<br><br>Plotting spatio-temporal data of intrusion routings. | Intrusion event tree that represents cause-effect interdependent menaces among echelons.<br>Analysis of modeled and running intrusion data. | The event tree in tabular or flow-chart format based on the "if-then" operation.<br>Look-up table of modeled previously and current data of intrusion menaces. | The properly selected modes of response of emitted ultrasound signals predict the sequent correct determination of cause-effect intrusion events. |
| Informational and Processing Inter-echelon Interrelation | Vindication of single or group intrusion detection signals.<br>Accomplishment of final, logically true decision of goal function of intrusion detection and protection. | Entry of caution and self-checking signals into verifying logical matrix.<br>Iterative resolution of the goal function during continuous status scan and data acquisition. | Entry of resulted data of treatment of caution and self-checking signals into: local logical equations of echelons, logical decision matrix and generalized resolving logical equation. | The current operation of system's data control block provides for data acquisition (in particular: caution and self-checking signals) due to continuous status scan of all detectors. |
| Intermediate derived data:<br><br>Finalized derived data: | The decisions of: logical equation of each echelon; logical decision matrix.<br>The decision of generalized resolving logical equation. | The menaces of echelons and their sublevels, and entire threat to the object.<br>The resolution of goal function of protection. | Data of continuous status scan input into any logical equation and into logical decision matrix only thru verifying logical matrix. | The verifying logical matrix analyses all caution and self-checking signals to avoid fault resolutions of the goal function. |
| Executive and Actual Instructions | Generation and entry of alarm signals and signals for actuation measures of prevention, protection and defense. | Entry of instructions for: Start of local preventive measures; and<br>Carrying out passive and active measures of final protection and defense. | Preferably the preventive local measures include entry of warning signals, actuation of barriers and entrapments against an intruding subject. | Alarm signals are being represented in the result of justification of caution signals for really effected echelon by the verifying logical matrix. |
| Trip and Results Log | Sampling and archiving the historical files of safety and security maintenance. | Continuous archiving all the samples of operating status of the system. | Informational archive data transferring goes in the two-way exchange mode. | Use from archive data file the antecedent resolutions of the goal function. |

FIG. 6

| Indices of echelons and sublevels therein | Event occurrence logical equation | Factors of menaces in the order of diminishing rate | Pre-designed selective security measures |
|---|---|---|---|
| $L_1$ | $L_1 + (L_1 \cdot S_2) + (L_1 \cdot C_1)$ = High level threat (**HT**) | (PO+OCF+CCF) • VAM | VAM + PO, →Intrusion prevention and start backup power. Other menaces, → Measures of intrusion protection and defense. |
| $L_2$ | $L_2 + (L_2 \cdot S_5)$ = High level threat (**HT**) | (CCF + OCF + PO) • VAM | The same as for $L_1$. |
| $L_3$ | $L_3 + (L_3 \cdot C_1)$ = Low level threat (**LT**) | (PO + DP) • VAM | Intrusion prevention : activate backup power, warnings, barriers, etc. |
| $L_4$ | $L_4 + (L_4 \cdot S_4)$ = **LT** | (PO + DP) • VAM | Intrusion prevention : activate backup power, warnings, barriers, etc. |
| **L** | $(L_1+L_2+L_3+L_4) + (L_1 \cdot L_2 \cdot L_3 \cdot L_4)$ = **HT** | (CCF+PO+OCF) • VAM | Selective activation of intrusion prevention, protection and defense. |
| $S_1$ | $S_1 + (S_1 \cdot S_3) + (S_1 \cdot C_1)$ = **LT** | (DF + IF) • VAM | Intrusion prevention : activate barriers, traps, redundant blocks, etc. |
| $S_2$ | $S_2 + (S_2 \cdot S_5)$ = **LT** | DF • VAM | Intrusion prevention : activate barriers, traps, redundant blocks, etc. |
| $S_3$ | $S_3 + (S_3 \cdot C_1) + (S_3 \cdot C_3)$ = Moderate level threat (**MT**) | (SSF + DF) • VAM | Selective activation of intrusion prevention, protection and defense. |
| $S_4$ | $S_4 + (S_4 \cdot C_1)$ = **HT** | (CCF + SSF) • VAM | Passive and active measures of intrusion protection and defense. |
| $S_5$ | $S_5 + (S_5 \cdot L_4)$ = **MT** | [(LF + SCF) • VAM] + [(LF • SCF) • VAM] | Selective activation of intrusion prevention, protection and defense. |
| **S** | $(S_1+S_2+S_3+S_4+S_5) + (S_1 \cdot S_2 \cdot S_3 \cdot S_4 \cdot S_5)$ = **HT** | {[CCF + (SSF + DF + LF + SCF +IF)] + [(SCF • LF) + (SSF • DF) + SCF]} •VAM | Selective activation of intrusion prevention, protection and defense. |
| $C_1$ | $C_1 + (C_1 \cdot S_1)$ = **MT** | {[SSF • (LF + DF)] +[(SSF • LF • DF)]} • VAM | Selective activation of intrusion prevention, protection and defense. |
| $C_2$ | $C_2 + (C_2 \cdot C_1)$ = **HT** | CCF • VAM | Passive and active measures of intrusion protection and defense. |
| $C_3$ | $C_3 + (C_3 \cdot S_3)$ = **HT** | [CCF + (CCF • SSF) + (CCF • DF) + (CCF •PO) + (SSF • DF) + (SSF • PO)] • VAM | Passive and active measures of intrusion protection and defense. |
| **C** | $(C_1+C_2+C_3) + (C_1 \cdot C_2 \cdot C_3)$ = **HT** | {CCF +[(CCF • SSF) + (SSF • DF) + (LF • DF)] • PO} • VAM | Selective activation of intrusion prevention, protection and defense. |
| **GRLE** | [(L • S) + (S • C) + (L • S • C )] + [(L • C) + (C • S) + (C • S • L)] = **HT** | {[(CCF + (CCF • SSF) + (LF • OCF) + (SSF • SCF) + (SSF • DF • IF)] • PO} • VAM | Passive and active measures of intrusion protection and defense. |

FIG.8

METHOD OF DEFENSE-IN-DEPTH ULTRASOUND INTRUSION DETECTION

CROSS-REFERENCE TO RELATED APPLICATIONS

2004/0140886 A1 7/2004; Inventors: Ronald Cleveland and Steve Wendler; U.S. Class: 340/431. 2005/0040947 A1 2/2005; Inventors: Mark C. Buckley, et al.; U.S. Class 340/567.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

REFERENCE TO A "MICROFICHE APPENDIX"

Not Applicable.

BACKGROUND OF THE INVENTION

1. Field of the Invention

The invention relates to the acoustic wave methods and systems for presence or movement detection and for distance or direction finding in the case of having a plurality of ultrasound type transmitter and receiver transducers. In particular this invention refers to condition responsive early indicating systems that exploit the registration of an occasional disturbance of ultrasonic wave beams in the manner of their reflection, refraction by edge diffraction and interference by shadowing, which disturbance has been made by either an intruding subject or a trespasser.

2. Description of Related Art

At present there exist methods and systems of ultrasound intrusion detection in an entire volumetric surveillance areas, in which areas there are being used different arrangements of transmitting and receiving transducers, at least namely:

- fan-shaped or matrix arrangements of transmitter and receiver transducers for stationary vector directing surveillance, e.g. U.S. Pat. No. 5,920,521 and U.S. Pat. No. 4,582,065 respectively;
- solitary arrangement of transmitter and receiver couples for scanning all over the surveyed area with narrow clusters of ultrasound beams, e.g. US 2004/0140886 A1; U.S. Pat. No. 4,644,509; U.S. Pat. No. 5,309,144;
- multi-seat arrangement of receivers along the perimeter of protected area for detecting an occurrence of ingress or egress intrusion thru the vicinity of protected area perimeter, e.g. U.S. Pat. No. 5,483,224 and U.S. Pat. No. 5,872,516;
- single-row or multi-row arrangement of transmitting and receiving transducers for realizing various processing operations with the help of reflected ultrasound beams, in particular:

- detection any strange subject inside the surveyed area, e.g. U.S. Pat. No. 5,761,155, U.S. Pat. No. 6,411,202 B1 and U.S. Pat. No. 6,518,915B2;
  - measurement of distance to intruded subjects or to the level of interface of liquid and granular materials, e.g. U.S. Pat. No. 4,949,074, U.S. Pat. No. 5,231,608 and U.S. Pat. No. 5,131,271, U.S. Pat. No. 6,323, 441B1 respectively;
- isolated arrangement of transmitter inside an enclosed area and positioning the receiver outside this enclosed area with the aim of detecting an occurrence of destroying the isolation of said protected area by an intruder, e.g. U.S. Pat. No. 4,807,255, U.S. Pat. No. 5,638,048, U.S. Pat. No. 6,430,988.

As is evident from the delivered above the elucidative examples, the modern methods and systems for ultrasound intrusion detection utilize preferably the phenomenon of reflection of ultrasound beams from strange subjects that occurred inside a surveyed area. Meanwhile, it is the known fact that the process of emitting-reception of airborne ultrasound signals depends strongly upon air ambient conditions (temperature, moisture, atmospheric pressure, etc.) and therefore it is restricted spatially. In turn, this restriction predicts the limitations upon volumetric dimensions of surveyed area and consequently on the capability of earlier warning detection of either an intruding subject or a trespasser. The alternative enhancement of the entire protected space might be realized by attaching to the ultrasound-surveyed area the proper number of adjacent areas, which areas were being surveyed with use of different physical principles of intrusion detection (infrared, microwave, light level sensing, etc.), e.g. see U.S. Pat. No. 4,857,912 and U.S. Pat. No. 6,127,926. Unfortunately, such a would-be method and arrangement will lead to hardware and software complexity, low reliability and great cost of an intrusion protection system as a whole. Nevertheless, it is necessary to establish such very method of intrusion protection that features with high reliability and self-defense, and meets the requirements to the multi-echelon arrangement of the protection systems of critical objects. Those strong requirements are delivered at least in the following regulations for such evidently critical objects as Nuclear Power Plants:

- Defense-in-Depth in Nuclear Safety, IAEA INSAG-10, LAEA, Vienna, 1996.
- Method for Performing Diversity and Defense-in-Depth Analysis of Reactor Protection Systems. NUREG for U.S.NRC/Prepared by G.G. Preckshot-Lawrence Livermore National Laboratory/Manuscript date: December 1994.

Furthermore, it seems to be relevant to emphasize some unique features of ultrasound that make it attractive for the purpose of faultless intrusion protection, namely:

- ultrasound waves are being emitted in the form of narrow directional beams and consequently do not travel around corners well, so beam patterns of the directional beams may be easily reflected or shielded by an intruded subject; or they may be refracted, i.e. diffracted by the edge of a subject having penetrated them into small part of their peripheral lobes;
- narrow solid angle of directional reception of airborne ultrasound may be obtained with relatively small dimensions of hidden receivers;
- ultrasound is not influenced by regular "white noise" of an environment, especially by an industrial ambient, being either inside or outside.

Besides, at the present time the ultrasound processing methods and instruments are being well practiced in even multi-modular hierarchical imaging, detecting and measuring systems that contain the similar ultrasonic instrumentation and hence are reliable, convenient and low-cost. This real advancement of the processing architecture is the actual prerequisite for improving ultrasound intrusion protection technology, which the present invention is devoted to.

BRIEF SUMMARY OF THE INVENTION

With the aim of introduction into the sense and art of the novel ultrasound intrusion detection technology provided by the present invention, it is necessary to identify the new basic objects of concern, as it is set forth below.

The principle object of the present invention is to establish a method of anticipatory ultrasound intrusion detection that enables the sufficient enhancement of distance of locating with airborne ultrasound waves for ingress or egress intrusion detection throughout the near field zone and circumjacent vicinity around a surveyed critical object.

Other object of the invention is to arrange the whole protected hemispheric, i.e. dome-type, volumetric room around a critical object in several juxtaposed areas, hence to create the multi-echelon infrastructure of defense-in-depth system in the form of multi-level substantial and solid openwork frame, outlined over the near field zone and circumjacent vicinity of a protected object regarding the maximum possible distance of propagation of airborne ultrasound waves along their incidence and reflection trip at the forecasted atmospheric conditions of the air ambient.

Further object of the invention is to determine the geometrical shapes and dimensions of 2-D polygonal or curvilinear areas, or 3-D curved surfaces of those echelons in correspondence with the spatio-temporal parameters of airborne ultrasound propagation and the available capabilities of selected ultrasound beam patterns to cover closely, without dead spots, all the said 2-D areas or 3-D surfaces with stationary or scanning ultrasound beam patterns. In turn, the selection of suitable beam patterns' characteristics (i.e. frequency range of a chosen transducer, effective transmitting-receiving distance of signals, solid angle of ultrasound beam pattern, rate of ultrasound attenuation, etc.) should be done with respect to the statistically forecasted conditions of ultrasound beam patterns' propagation in the air ambient around a protected object, e.g. the annual average of temperature, humidity, atmospheric pressure, cross wind flows, etc.

Another object of the invention is to compose a graphic-analytical model of intrusion vulnerability for each individual echelon, taking to consideration the real layout of protected object and the optional models of spatio-temporal behavior of intruder or trespasser on their assumed routings, and the chosen mode of response of the emitted ultrasound signals (i.e. reflection, refraction by edge diffraction and interference by shadowing).

The other object of the invention is to choose and assign for each echelon the pertain method of ultrasound intrusion detection regarding the mode of ultrasonic beam response, which should match the predetermined behavior of an intruding subject or a trespasser on their presumptive routings.

The further object of the invention is to compose the generalized graphic-analytical model of intrusion vulnerability for the entire protected dome-type volumetric multi-echelon structure that is being outlined in the form of multi-level substantial and solid openwork frame over the near field zone and circumjacent vicinity around a critical object. This generalized model must establish the logically correct interrelation amongst juxtaposed and even non-adjacent echelons that is destined to intrusion justification, presentation of alarm signals, and actuation the protective and defensive measures. This interrelation is based on the principle of early and preventive ultrasound detection of ingress or egress intrusion, where this principle consists in gradual generating and triggering of caution, self-checking, intrusion vindication, and alarm and security activating signals in the result of logical processing of ultrasound signals acquired during continuous status scan of detectors in all the echelons.

Still further object of the invention is to establish the basal architecture of hardware and draw up the sequentially operating software that should be utilized for all different ultrasound beams' response modes involved. The software apparently should represent an algorithm, which is being compiled on the basis of the intrusion event tree. This software algorithm should accomplish logical operations for presentation of the signals of intrusion detection and justification, and also for triggering the signals of intrusion prevention, protection and defense in the result of logical processing of caution and self-checking signals, acquired during continuous status scan of ultrasound detectors (i.e. receivers and transceivers) in all the echelons. Since the single or multiple intrusion may occur in the multilevel structure of a protected object in various though predictable combinations, the techniques of plotting the event tree and setting up the generalized graphic-analytical model should utilize the deterministic situational logic transition with IF-THEN operator.

The specific content of the invention, as well as other objects and advantages thereof, will clearly appear from the following description and accompanying figures.

BRIEF DESCRIPTION OF THE SEVERAL VIEWS OF THE DRAWINGS

Method of the present invention will now be described with reference to the figures by way of illustration, in which the fundamentals of the method of ultrasound multi-echelon intrusion detection are represented, in which like reference characters indicate like elements of method's techniques and arrangement, in which explanations of these techniques and arrangement are given, and in which.

Figure 1:
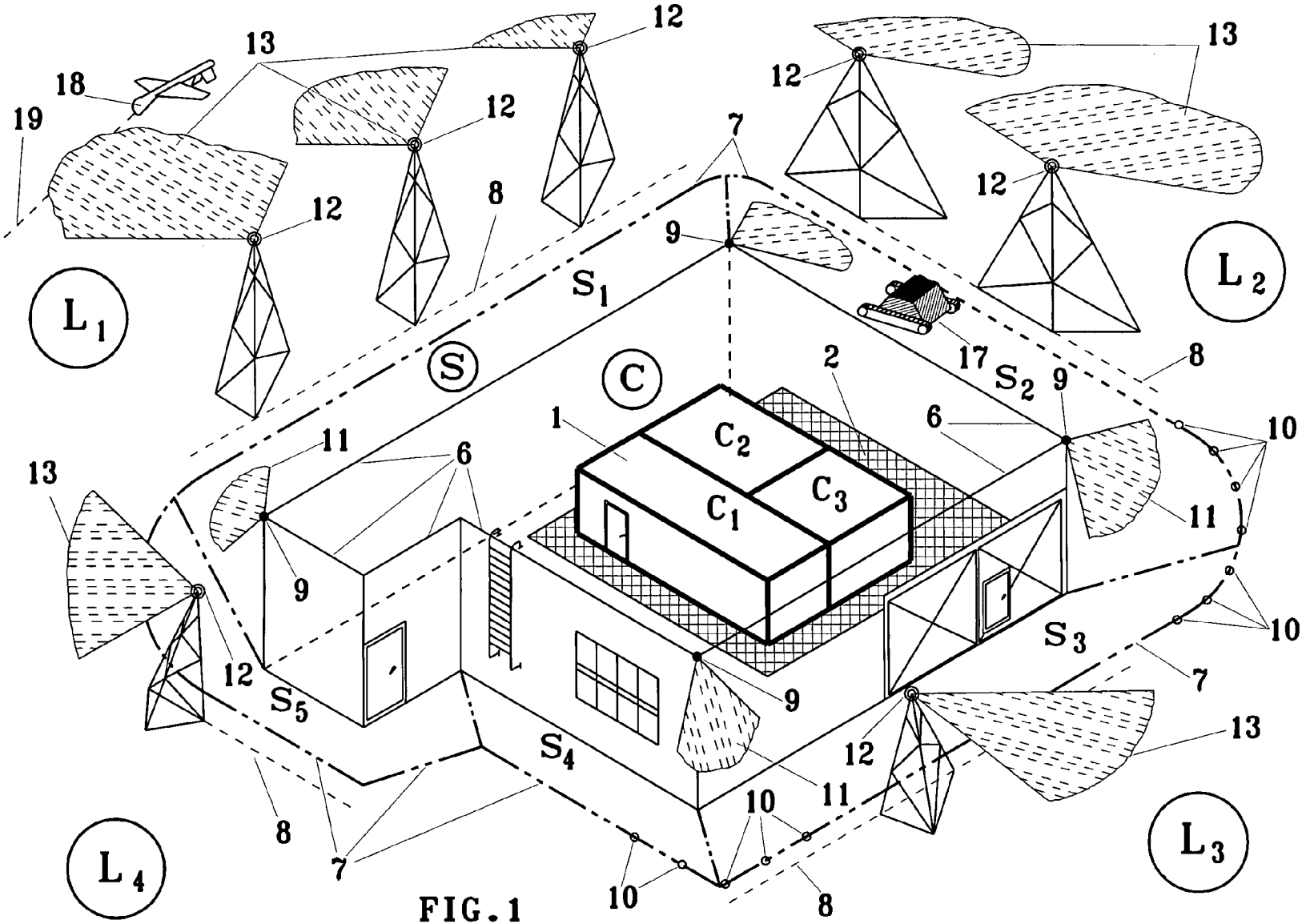
FIG. 1 illustrates in axonometric view the general layout of a protected object with the spatial erection diagram of disposition of transceivers in echelon L and oppositely mounted pairs of transmitters and receivers in echelon S. This general layout includes the bulky protected building (e.g. the reactor building, or the warehouse with ammunition, etc.) with closed premises of echelon C, which building is surrounded by prohibited areas and access roads of echelon S. Along the outer frontier of echelon S there are installed the masts of the optional embodiment of the openwork frame of echelon L that carry those transceivers.
Figure 2:
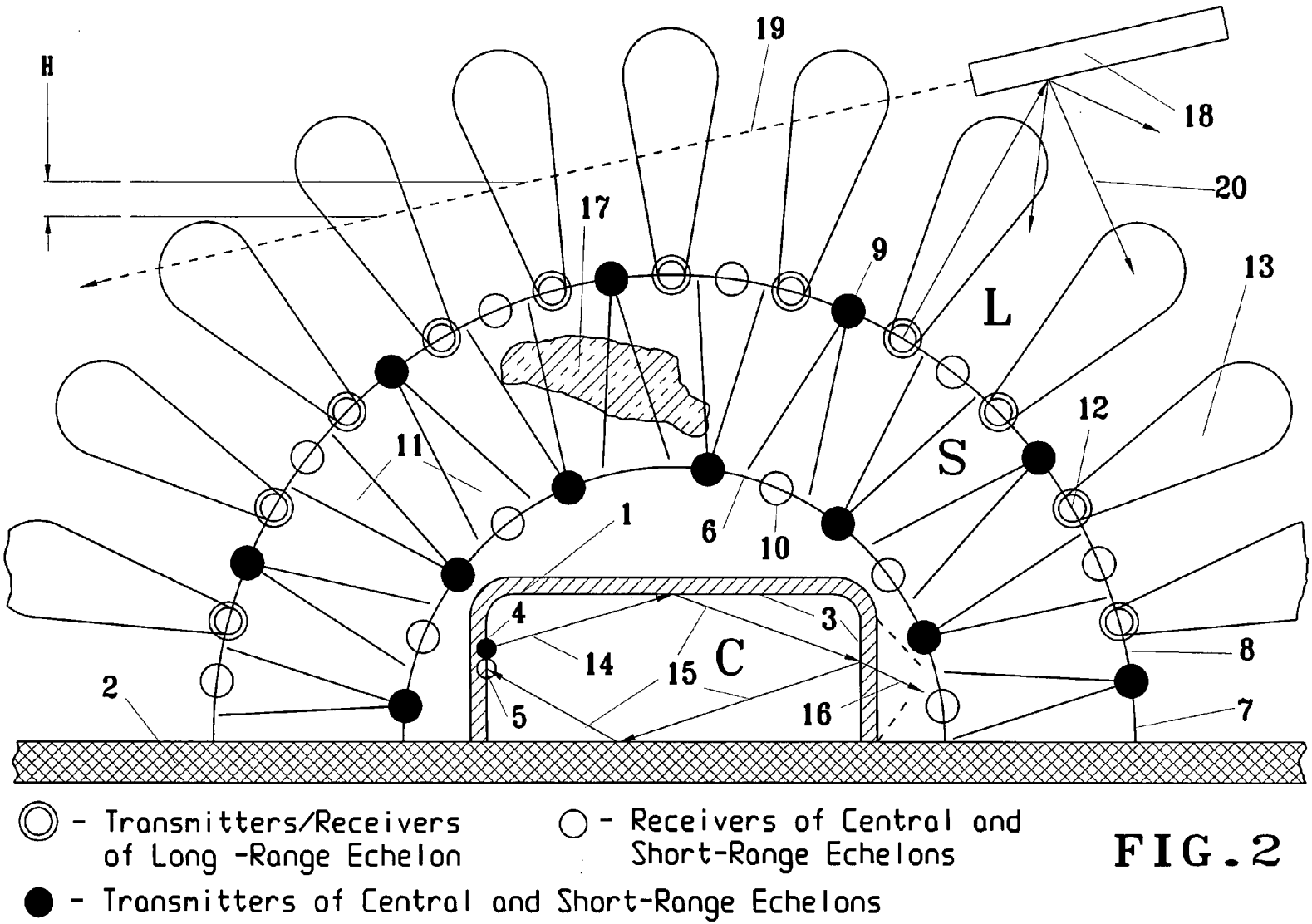
FIG. 2 shows schematically the view of profile (i.e. the vertical section) of an alternative embodiment of a defense-in-depth ultrasound multi-echelon intrusion detection spatial structure in the form of hemispheric (i.e. dome-type) multi-level substantial and solid openwork frame, outlined over the near field zone and circumjacent vicinity of a protected object, which structure provides for the enhanced distance of target location by the airborne ultrasound waves. Accordingly to the present invention, this structure has been arranged in possession of juxtaposed the central (C), short-range (S) and long-range (L) areas. These areas represent the corresponding echelons of ingress or egress ultrasound intrusion detection.

As shown at FIG. 1 and FIG. 2, the central echelon C is being arranged inside the premises of the enclosed housing of a protected critical object 1. In this closed echelon there is being used the ultrasound intrusion detection by the stationary vector directing or space scanning techniques with reflection and refraction by edge diffraction response of ultrasound beams. The sets of transmitters and receivers are being mounted inside the premises of this object 1. In the alternate embodiment of the method thereof, transmitters may be mounted inside each of the premises of the object 1, while receivers correspondingly are mounted outside these premises for detecting any breakage of their enclosures (broken walls, opened doors, windows, etc.). That case the receivers may be mounted at the peripheral outline of echelon C, or where the adjacent echelon S begins.

The short-range echelon S is being shaped in the form of the 2-D polygonal or curvilinear areas, or 3-D curved surface areas at the adjoining vicinity of external peripheral outline over the buildings with enclosed premises of echelon C and over the other outdoor installations of a protected critical object (e.g. main transformers, emergency generators, etc.). The inner outline of echelon S is the substantial planar or volumetric solid openwork frame arranged on the engineering structures of protected facilities. In the short-range echelon S there is being used the ultrasound intrusion detection by the stationary vector directing or space scanning technique with refraction by edge diffraction response or with interference by shadowing response of ultrasound beams in the result of respectively intersection or shielding of these beams by an intruding subject or a trespasser.

At least one long-range echelon L is being arranged outwardly and adjacently to the outer peripheral outline of the short-range echelon S. In the long-range echelon L there is being used the ultrasound intrusion detection by preferably the stationary vector directing technique with an occasional reflection response of ultrasound beams from the surface of an intruded subject.

FIG. 3 shows the verifying logical matrix (VLM) that represents the interrelation of ultrasound detection signals, acquired from different juxtaposed and non-adjacent echelons C, S and L. Since this logic of signals is being used for intrusion justification, the self-checking signals are being foreseen for every echelon that enables to analyze the current operating status of each echelon. The simultaneous appearance of caution and positive self-checking signals should vindicate that an intrusion has occurred in the checked echelon. At the appearance of an abnormal (i.e. non-determined by design) sequence of caution signals, the control software algorithm of the system (set forth below) should apply IF-THEN operator (logical implication) for starting the situational logic transition (SLT) of self-checking signals. The order and time domain of entry of caution signals from sublevels of echelons should determine the real vector (i.e. direction and speed) of intruder's motion throughout the protected area.

FIG. 4 represents the tabular format of the event tree that establishes the supposed inter-echelon interdependence of intrusion vulnerability, namely the cause-effect menaces (i.e. threats) at single intrusion and the cross-linkage of those menaces at multiple intrusion. This interdependence is being examined herein for the arrangement of the system shown at FIG. 1. The event tree contains the basal set of situational combinations of supposed intrusion events. The techniques of plotting the event tree is based on the theory of combinations for simple arrangements with a few sublevels in one or two echelons, whereas for the complex arrangements, see FIG. 1 and FIG. 2, it is based on the complete Markov models with Boolean transition logic. The symbols and acronyms used in FIG. 4 should be understood as follows:

X—designates the occurrence of single intrusion, therefore it is shown in the rows at intersections of the similar symbols of echelons' sublevels, e.g. $S_3$ & $S_3$, or multiple intrusion, once it is shown in columns at intersections of the similar and different symbols of echelons' sublevels, e.g. $[(S_3\&S_3)\ \&\ (S_3\&C_1)\ \&\ (S_3\&C_3)]$. The expected sequent cause-effect events and real menaces of single intrusions are symbolized in the rightmost column of the table, while those events and menaces at multiple intrusions are symbolized in the bottom row therein.

VAM—violation of access mode, i.e. the non-authorized and threatening presence or movement of an intruding subject or a trespasser.

IF—independent failure, i.e. the self-maintained failure of a component.

DF—dependent failure, i.e. the failure that occurs in one echelon in dependence of a failure that has occurred either in the same echelon or in juxtaposed or non-adjacent echelon.

SSF—system single failure, i.e. the failure of the system as a whole, once this system has one or more single points of failure to occur.

LF—latent failure, i.e. an implicit failure that may provoke any severe damage due to the fault-induced degradation.

CCF—common-cause failure, i.e. components failure result from a single shared cause and coupling mechanism.

SCF—short-circuit failure.

OCF—open circuit failure.

PO—power outage.

Figure 5:
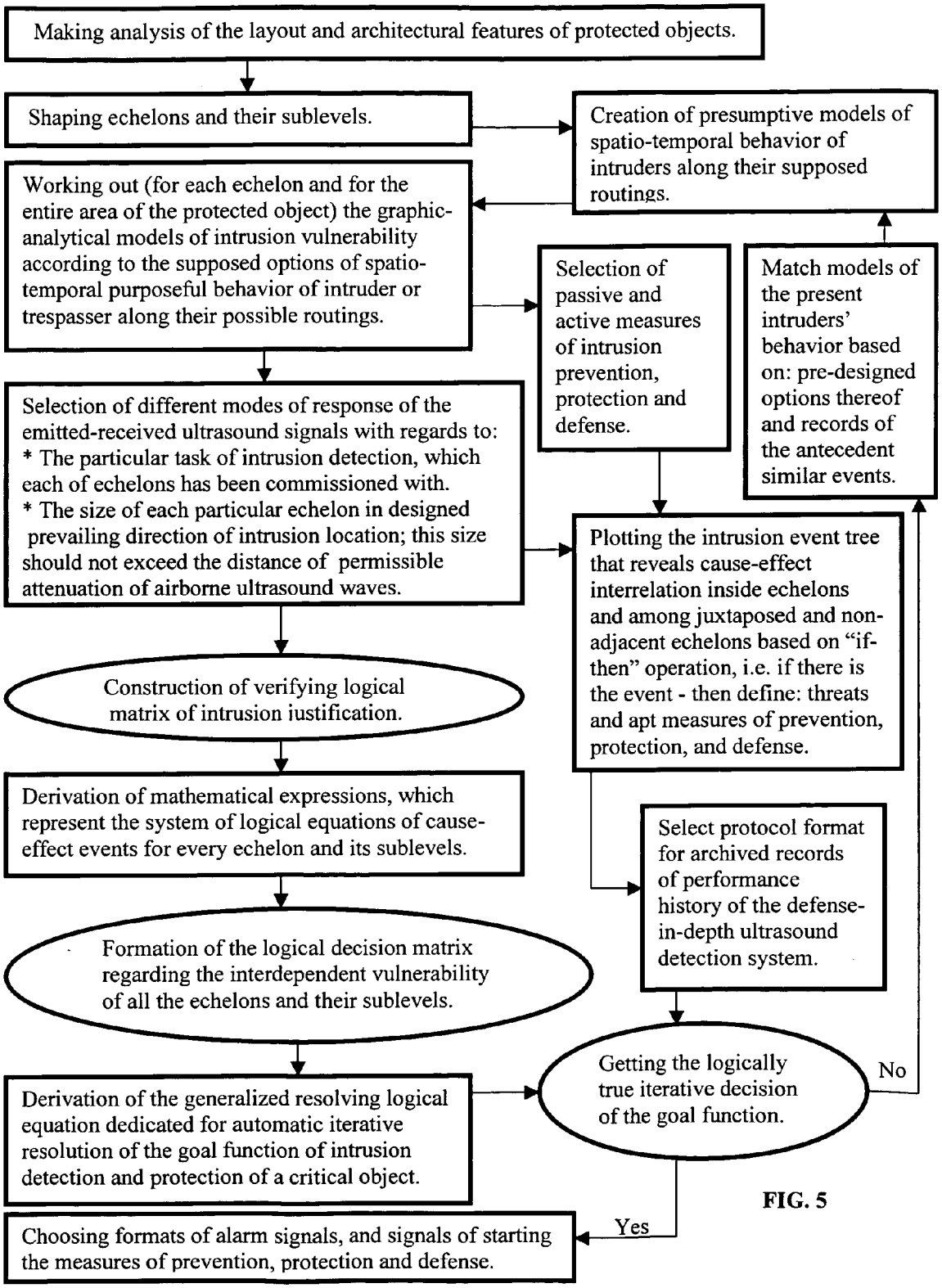

The flow chart of FIG. 5 reveals the basics of building of informational and processing logical interrelation among juxtaposed and non-adjacent echelons of the defense-in-depth ultrasound intrusion detection system. Actually this flow chart represents the requirements specification for accomplishment of the system design.

FIG. 6 reveals the basics of design and operational features of control software algorithm which is being composed to treat and handle automatically in the real time domain the inter-echelon informational and processing interrelation.

Figure 7:
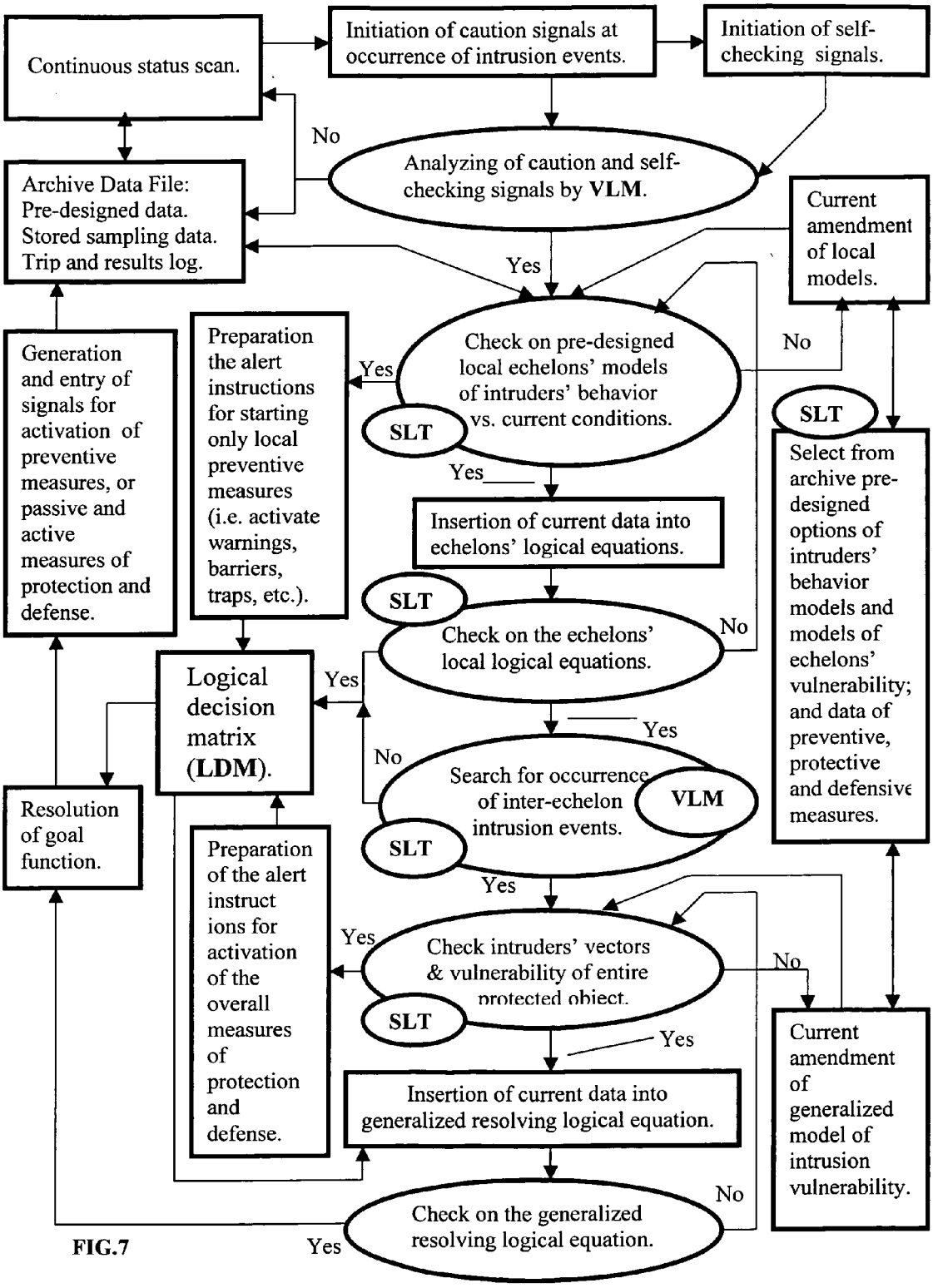

FIG. 7 represents the flow chart that contains the structure and logical functionality of control software algorithm. Since spatio-temporal data of intrusion situations may change abnormally regarding the design data, though in predictable (i.e. deterministic) format, the control software algorithm should include the functions of deterministic situational logic transition (SLT) driven by IF-THEN operator.

FIG. 8 represents the tabular pattern of the logical decision matrix (LDM) with examples of local echelons' logical equations (LELE) and generalized resolving logical equation (GRLE). LDM is being set on the basis of the beforehand designed event tree, see FIG. 4. This tabular pattern is the example of setting up LDM at the systems' design stage. It reveals the role of LDM in derivation of GRLE which is destined for resolution of the goal function of the ultrasound intrusion detection. The identification indices (L, S, and C) of echelons are used in this pattern to symbolize the facts of intrusion occurrence in the corresponding echelons and their sublevels (e.g. $L_1$, $S_2$, $C_3$, etc.). The acronyms in the third row from the left have just the same definitions as those in FIG. 4. The second row from the left contains LELE (i.e.

event occurrence logical equations) where the order of setting the echelons' symbols from the left to the right should reveal the presence and direction of motion of an intruding subject or a trespasser. The local echelons' logical equations are being derived with use of operators of Boolean algebra, namely with AND operator [(·) or (&)] and OR operator (+) that realize respectively the AND operation (i.e. logical multiplication, or conjunction) and OR operation (i.e. logical addition, or disjunction). Acronyms LT, MT, HT define respectively low, moderate, and high levels of threat of single or multiple intrusion occurrence. The rate of threat is being defined by VLM in correlation with the pre-designed event tree, see FIG. 3 and FIG. 4, since this matrix features the technique of deterministic SLT driven by IF-THEN operator. Thus, the threat level should be derived from the analysis of the place of presence and vector of motion of an intruding subject (e.g. unmanned airborne or ground vehicles) or a trespasser, see FIG. 1. The threat level strongly depends on the vulnerability of the critical facilities situated inside an intrusion-effected area, so that a single-echelon intrusion may be of HT level vs. a multi-echelon intrusion of LT level. The results of such continuous situational analysis of single-echelon or multi-echelon intrusions are being sequentially inserted in equation of each echelon and its sublevel, and then transferred into GRLE, see FIG. 8. Once the system of ultrasound intrusion detection is under design stage, the values of intrusion threats (i.e. the menaces) are being estimated for probable cause-effect damages of protected facilities and sequent losses rated on the basis of the single failure criterion. At the rightmost column there are represented the pre-designed selective security measures. The LELE and GRLE equations, and respectively those selective security measures would be being changed automatically, provided the control software algorithm has applied the function of deterministic situational logic transition (SLT) regarding the results of continuous checking the caution and self-checking signals by VLM, see FIG. 3 and FIG. 7.

Figure 9:
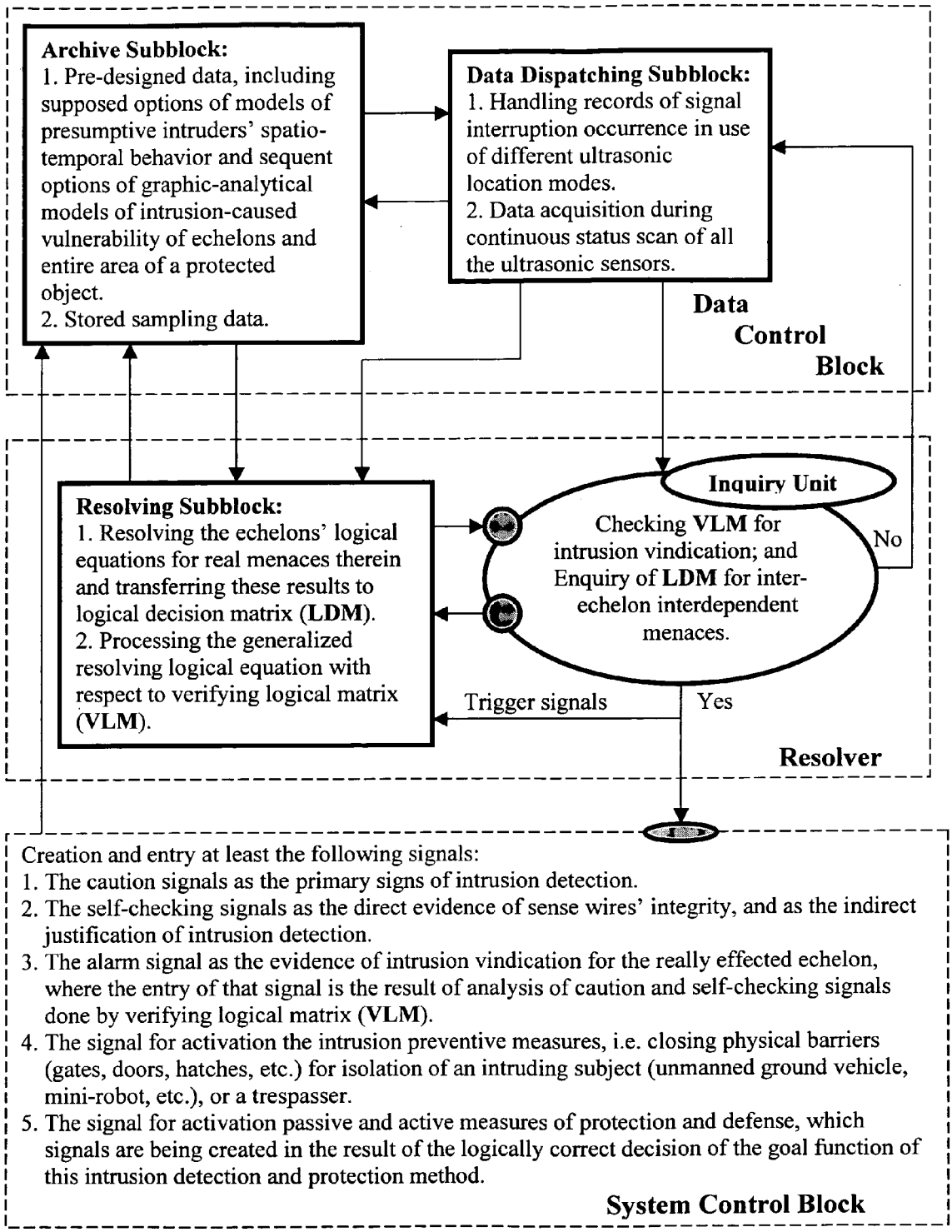

FIG. 9 depicts in the format of the flow chart the basal structure of the system's hardware that contains at least data control block, resolver, and system control block. This flow chart illustrates the essentiality of operating functions of each component therein as far as the interrelating links of the functional architecture of the hardware assembly. The inquiry unit of the resolver possesses the feedback loops to data dispatching and archive subblocks of the data control block. Therefore, any running abnormal changes in intrusion situations are being followed with triggering the procedure of SLT by this inquiry unit in response to the results of checking VLM for intrusion vindication and enquiry of LDM for inter-echelon interdependent menaces.

DETAILED DESCRIPTION OF THE INVENTION

The subject matter of the present invention is being unveiled by the description of the innovative approach to the use of various ultrasound detection techniques and their logical interrelation that constitute the basic content of the Method of Defense-in-Depth Ultrasound Intrusion Detection and arrangement of the same. The following detailed description is expected to deliver the appropriate explanation to advantages of these techniques and their beneficial interaction in ultrasound early and anticipatory intrusion detection procedure.

At least one of the vital secure needs of a critical object (e.g. Nuclear Power Plant, refinery, offshore rig, flowing plant of gas-main pipeline, moored ship, plane station, helipad, etc.) is that of the reliable and stealthy intrusion protection system, see FIG. 1 and FIG. 2. The protection reliability is to be enabled by use of early and preventive detection of an intruder or trespasser. The secrecy, in turn, may be realized thereto by utilizing ultrasound technology for detecting the presence or motion of subjects, because it is difficult to notice or suppress ultrasound waves in air without special detectors and suppressing generators respectively. The presence or motion of suspected subject within a surveyed area should result in reflection; refraction by edge diffraction or interference by shadowing of the airborne narrowly directed ultrasound beams. Keeping in mind that ultrasound attenuates in air quickly enough, it seams reasonable to arrange the whole protected room around a critical object in several juxtaposed inside and/or outside areas. These areas represent juxtaposed echelons of the entire defense-in-depth intrusion protection dome-shaped volumetric structure. The number of echelons, their shape and space dimensions depend upon the real layout of a protected object, the amount of protected volumetric room, the available spatial-temporal parameters of the airborne ultrasound propagation in forecasted conditions of the air ambient, and the predetermined behavior of an intruding subject or a trespasser on their assumed routings.

The mentioned above expected behavior predestines correct selection of relevant ultrasonic detecting technique and instrumentation for each surveyed echelon. In compliance with the present invention the system of the ultrasound defense-in-depth protection of the entire surveyed room must be organized in data interaction format that includes continuous logical processing of acquired signals according to the fallowing signal justification procedures, see FIG. 3 and FIG. 9:

- simultaneous location inside all the echelons with forming the caution signals in case of presence or motion of suspected subjects at least in one of the said echelons;
- keeping under surveillance the motion of suspected subjects throughout the juxtaposed and non-adjacent echelons with forming the intrusion vindication signals, if this motion is defined as an intrusion that threatens the protected critical facilities of an object;
- forming self-checking signals for verification of an intrusion occurrence by the current check of performance reliability of ultrasound detection facilities of every echelon;
- logically processing the caution signals and intrusion vindication signals, and presentation of the alarm signal as well as the necessary security activating signals in accordance with the designed goal function of the said ultrasound detection and protection technology of the present invention.

As it is shown at FIG. 1 and FIG. 2, the whole room around a critical object is being arranged at least in three juxtaposed areas that are defined as central C, short-range S and long-range L echelons. The central echelon C is being arranged inside the normally enclosed at least one premise with the protected installation of a critical object 1 that optionally is placed on a supporting base 2 acting as a passive protection structure of the object from beneath. The inside reflecting surfaces 3 are being constructed to enclose normally the protected installation of object 1. At least one pair of transmitter 4 and receiver 5 is being mounted inside the enclosed area of echelon C. Over the echelon C there is being arranged the internal border 6 of the short-range echelon S. The external border 7 of echelon S is being made to coincide with the frontier 8 of the open to outside the echelon L. In dependence on the real layout of a protected object 1 and hence on the physical volumetric shapes of surveyed echelons C, S, and L the said borders 6 and 7, and frontier 8 are being configured like either 2-D polygonal or curvilinear, or 3-D curved spatial surfaces of a substantial solid openwork frame, or in any combination thereof. The internal border 6 and external border 7 of the short-range echelon S both are being equipped with alternate pairs of the mounted opposite each other transmitters 9 and receivers 10, so that all of the area of echelon S is filled in with ultrasound beam patterns 11 (not shown completely to avoid encumbering of FIG. 1), which beam patterns are arranged closely and directed opposite each other. If the dimension of echelon S in the designed prevailing direction of ultrasound location is bigger than the admitted value of the airborne ultrasound wave attenuation along its one-way emission trip from a transmitter to the opposite receiver, this echelon should be divided into several sublevels. The dimension of each sublevel in the designed prevailing direction of location must provide for such admissible value of ultrasound attenuation in the forecasted conditions of the air ambient where the received signal is not less than the dead band of the ultrasonic receiver chosen for the average values of conditions of the air ambient. The outer surface of solid openwork frame of frontier 8 of echelon L is equipped with integrated transmitter-receiver transducers, i.e. transceivers 12, disposed in the form of preferably chequerwise lattice, so that a sort of umbrella barrage of emitted upstream ultrasound is being formed by closely adjacent beam patterns 13 where some of the transceivers 12 may be directed stationary, while another are being pivoted for scanning the solid angles that overlap each other.

The principal operational character of each echelon is based upon the chosen ultrasound detecting technique, which technique features distinctive mode of emitting of ultrasound signal and registration of its occasional disturbance regarding the expected mode of ultrasonic beam's response. Since the central echelon C represents at least one normally enclosed premise, it is reasonable to use therein the technique of ultrasound echolocation. The narrow ultrasound beam 14 is being emitted inward the enclosed area of echelon C and consequently reflected from inner surfaces 3 in the form of returned beam 15, provided these beams were not disturbed by the presence of an intruder. Otherwise, said returned beam 15 will be changed and receiver 5 consequently will register an intrusion. If the integrity of enclosure of object 1 were destroyed, see dashed lines at FIG. 2 (broken walls, opened doors or hatches, etc.), the emitted beam 14 or some of the reflected beams 15 would go outward in the form of released beam 16 that might be registered by one of the receivers 10 of echelon S. In the result, an ingress or egress intrusion should be registered. Thus, inside echelon C there are being realized the couple of ultrasound techniques, namely: the ultrasound echolocation inside the enclosed premises with use of reflection of ultrasound beams; and detection of accidentally outward released the airborne ultrasound by direct receiving its beams with receivers 10. The arrangement of the receivers 10 is being preliminary designed so that their beam patterns could overlap the areas of openings and expected damages of the enclosure of object 1. So far as echelon S is being designed for protection of proximate outside area of near field zone around the object 1, it appeared to be reasonable to use the technique of ultrasound beam interference because an expected intruder has to cross this echelon along his ingress or egress motion. In this case an intruded target 17 should interfere or shadow the ultrasound beams 11 going from transmitters 9 to receivers 10 throughout echelon S. Optionally, the interference of an intruded target with the surveying beam patterns of echelon S may lead to refraction of said beam patterns by the edge diffraction phenomenon. Well, the refracted, i.e. edge diffracted ultrasound beam pattern should register the event of penetration of an intruding subject into the small part of its peripheral lobes. This small part of in-lobe penetration is less than the wavelength of airborne ultrasound emission, which is approximately of 0.3445" or 0.875 cm. at frequency of ≈40 kHz in normal ambient air conditions. So that, this mode of beam pattern response should provide for fast and correct detection and tracking of an intruder that tries to cross the frontiers and enter inside area of echelon S or to move inside this echelon. At the echelon S there may be utilized the target detection with use of techniques of unit stationary vector directing, stationary vector lattice arranging or unit/group vector scanning where selected number of receivers 10 operate in the scan mode but the rest number of receivers 10 and all the transmitters 9 operate in stationary vector directing mode. The purpose of activation of the selected group of receivers 10 for in-phase scanning is the vindication of intruder's presence inside echelon S and definition of vector of its motion that represents the direction and speed thereof. Since in the alternative arrangement of the present invention echelon S may be divided into several adjacent subechelons $S_1$, $S_2$, $S_3$, . . . $S_{n+1}$, where dimensions of each echelon are limited by the distance of feasible propagation of airborne ultrasound waves in the forecasted conditions of ambient air, the distance of ultrasound detection inside echelon S should be sufficiently enhanced.

The external echelon L is being designed for protection of circumjacent dome-type air vicinity of the layout area of the critical object 1 with the aim of early and anticipatory intrusion detection, see FIG. 1 and FIG. 2, where an intruded target 18 must be found at its trajectory 19 of approaching this protected object. Since ultrasound beams 13 of echelon L are being emitted continuously outward the frontier 8, and since they may return only when having been reflected from a random target in the form of reflected beams 20, it appeared to be reasonable to apply the ultrasound beam reflection with use of stationary vector directing, stationary vector lattice arranging or unit/group vector scanning techniques where the selected number of transmitter-receiver transducers 12 may operate in stationary vector directing mode and the rest number of said transducers may operate in the volumetric scan mode. The solid openwork frames of echelons S and L may be designed for 2-D polygonal or curvilinear, or 3-D curved surface array arrangement of pairs of transducers 9 and receivers 10 (echelon S), and of transmitter-receiver transducers 12 (echelon L) in dependence on the layout and enveloping space shape of the protected buildings and outdoor installation of the object 1. The purposeful choice of one of these techniques of ultrasound emitting-receiving and the arrangement of transmitter-receiver transducers 12 are being done in dependence on the preliminary assumed graphic-analytical model of intrusion vulnerability of the long-range echelon L. Since the behavior of target 18 inside echelon L is really crucial for all the consequent intrusion protection activity, there is being organized the estimation of the main parameters of said behavior. For example, the analysis of the changes of dimension H and speed of an approaching subject in time and value, see FIG. 2, may run the assessment of the threatening approach of target 18 to a protected object 1 or may indicate the invulnerable passing by of this subject.

Optionally, Doppler effect may be used for intrusion detection and signal processing inside area of the long-range echelon L.

When the system of ultrasound detection is under design, one should use the techniques that constitute the subject matter of the present method of ultrasound intrusion detection. While FIG. 1 and FIG. 2 represent the goal and formats of ultrasonic intrusion detection for the purpose of defense-in-depth protection of a critical object, the basics of the design methodology thereof are clarified by FIGS. 3–9. Besides, FIG. 7 contains the structure and logical functionality of control software algorithm that should be used for writing in advance the program of automatic operation of the system, whereas FIG. 9 represents the basal architecture of the system's hardware.

The verifying logical matrix, shown at FIG. 3, predetermines the operating regime of continuous status scan of all the ultrasonic sensors for detection of disturbance of ultrasound beams and for checking simultaneously the integrity of wiring of the entire system. The event tree, shown at FIG. 4, contains the anticipated situational combinations of intrusion occurrence. For relatively simple arrangements of systems of ultrasonic intrusion detection with a couple of echelons, each comprising a few sublevels with single units of protected equipment, the event tree can be composed with use of theory of combinations and technique of situational logic transition, as it is demonstrated herein by FIGS. 1–9, whereas for the complex arrangements (i.e. for the multi-echelon systems with plurality of protected units of equipment installed in each echelon or in its sublevels) the event tree should be composed on the basis of complete Markov models with Boolean transition logic. The data sharing of verifying logic matrix and event tree enables to organize the systematized programmable analysis of the directional sequence of retrieved signals and to assess direction, intensity and at last the real security threat (i.e. menace) of intrusion to the buildings, works and installations of a protected object 1. This analysis of real security menace is being accomplished with respect to the preliminary composed the local echelons' graphic-analytical models of predictive vulnerability for each of the echelons and the generalized graphic-analytical model of the presumptive intrusion vulnerability for all the multi-echelon protective structure. Each of the local echelon's graphic-analytical models is being composed in accordance with the real layout of the protected echelon and presumptive spatio-temporal behavior of an intruder, and with the ultrasound detecting technique of emission-response, chosen for each echelon C, S and L. If to say rather more detailed, the working-out of the graphic-analytical model of intrusion vulnerability for each echelon is being accomplished with regard to the supposed options of spatio-temporal purposeful behavior of intruder or trespasser along their possible routings inside premises of the central echelon C, around buildings and works of short-range echelon S, within reach of ultrasound location inside the space of the long-range echelon L. The options of ingress or egress routings of intruder or trespasser thru every echelon are also being searched with taking to account the layout and architectural features of the available stationary or movable protective barriers against an intrusion, and various assumed ways of the trespassers' accessibility to the critical works and installations therein. The results of search of these options are being used for verification of geometrical shape of every echelon by comparison of spatio-temporal parameters of intruder's or trespasser's purposeful behavior with spatio-temporal parameters of ultrasound beams' propagation and signaling response in designed prevailing directions of location. Then the echelons' logical equations are being set up in advance to reveal the factors of menaces inside the echelons, see FIG. 4, and sublevels therein based on the graphic-analytical models of intrusion vulnerability, which is being estimated for probable cause-effect damages of protected facilities and sequent losses rated on the basis of the single failure criterion. This criterion defines that this vulnerability should be increased for facilities, which belong to some sublevels inside one echelon or to different echelons at the same time.

The generalized graphic-analytical model is being compiled with taking to consideration the specificity of each local echelon's model and the software-programmable inter-echelon informational and processing logical interaction among sublevels of each echelon and among juxtaposed and non-adjacent echelons. Those features are presented by FIGS. 3, 4 and 8. Besides, FIG. 3 illustrates the inter-echelon tracing of an intruding subject or a trespasser. The said generalized graphic-analytical model is being prepared, including the steps of:

designation of available stationary (i.e. partitions, false corridors, etc.) or movable (doors, hatches, grids, etc) physical barriers for having used them as hindrances to access the critical installations and as entrapments along the presumed routings of an intruding subject or a trespasser where this designation is being fulfilled regarding the previously simulated model of the presumptive spatio-temporal behavior of an intruding subject or a trespasser; and definition of the territorial contours and limits of operating time, violation of which with the non-authorized presence or movement of an intruded subject or a trespasser should be considered as violation of access mode and the actual hazardous intrusion; and plotting the intrusion event tree in the form of graphic representation or table matrices which identify the interrelations of sublevels inside any echelon, and among juxtaposed or non-adjacent echelons that are based on the sequence of the cause-effect events of registration of an intrusion occurrence and definition of the vulnerability and menaces due to the presence and motion of an intruded subject or trespasser; and accomplishment of the graphic presentation of intrusion event tree on the floor plans of enclosed premises of echelon C and on the lay-out of the near field zone of echelon S for detection of intrusion cause-effect cross-linkages and respective facts of intrusion menaces among sublevels inside echelons, and among juxtaposed and non-adjacent echelons C, S and L; and further setting up the generalized graphic-analytical model in the form of graphic-and-analytical representation of inter-echelon dependable vulnerability at occurrence of one or a few intrusions in one of the echelons, or in some of them simultaneously where the analytical part of graphic-and-analytical representation is being set with use of the deterministic situational logic transition.

So that, the generalized graphic-analytical model and verifying logical matrix, see FIG. 3, are being used for prediction of the variable vector of the assumed intruder's threatening motion throughout the echelons and for programming the logically motivated sequential presentation of the caution, self-checking, intrusion vindication signals, and triggering the final signals of alarm and starting the passive and active measures of protection and defense. The presentation and triggering of final signals of alarm and starting the security measures is the goal function of this method of ultrasound intrusion detection.

The inter-echelon informational and processing logical relation is being treated and handled by the logical decision matrix, which is the constituent of the control software algorithm, see FIGS. 7 and 8. The logical decision matrix (LDM) is being designed by placing top-down into the main column all the sublevels of the echelons and entire echelons in the order of defense-in-depth structure, beginning from echelon L, and further by arranging all factors of menaces, drawn from these echelons' logical equations, in the rows against the respective echelons' sublevels and entire echelons in the order of the diminishing rate of said factors of menaces, as it is shown at FIG. 8.

The generalized resolving logical equation (GRLE) is being set up in the result of the analysis of logical decision matrix and generalized graphic-analytical model of the intrusion vulnerability with regard to an intrusion cause-effect cross-linkages among sublevels inside echelons, and among juxtaposed and non-adjacent echelons C, S and L. This analysis is being done as at the design stage as during operating mode of the system, see FIG. 5 and FIG. 7.

The goal function of ultrasound intrusion detection is being iteratively resolved, see FIG. 7, during continuous status scan and data acquisition by the sequential procedure in the steps of:

- solution of the echelons' logical equations for justification the fact of intrusion menace; and
- carrying out running analysis of acquired facts of intrusion menaces by logical decision matrix, and
- processing the generalized resolving logical equation by the control software algorithm with respect to the verifying logical matrix.

According to the present invention the informational and processing logical interrelation among either juxtaposed or non-adjacent echelons L, S and C is being treated and handled by the logical decision matrix of the control software algorithm, which algorithm operates the continuous status scan of all the ultrasonic transceivers and oppositely aligned pairs of transmitters and receivers in every echelon simultaneously, and which algorithm, see FIG. 7, provides for:

- transferring the acquired data of continuous status scan to the system of echelons' logical equations, verifying logical matrix, and logical decision matrix;
- ability of the resolver, governed by the software algorithm, to process the acquired data by the echelons' logical equations, the verifying logical matrix, the logical decision matrix and the generalized resolving logical equation up to the logically correct decision of the goal function of the intrusion detection and protection method;
- creation and presentation of logically true sequence of the caution and self-checking signals for every intrusion-suspected echelon, see FIG. 3, signal of intrusion vindication for the really effected echelon, and triggering the final signals of alarm and actuation of security measures;
- generation and triggering of signals of starting the security measures of active and passive protection and defense which measures include at least: activation of the alarm system, enclosing the movable physical barriers around the protected works and installations, hence entrapping a trespasser on its actual routing preferably inside echelon C, application of disabling tear gas, involving the guard troops, deploying inflatable air obstacles in echelons S and L or opening the defensive fire in echelon L.

The instrumentation of ultrasound intrusion detection and protection system should consist of at least, see FIG. 9:

- the resolver, which handles the system of echelons' logical equations, the verifying logical matrix, the logical decision matrix of inter-echelon factors of menaces, and the generalized resolving logical equation;
- data control block that operates the modes of locating with ultrasound beams and the data acquisition procedure; and
- system control block that forms and presents, and trigger the signals of intrusion detection, justification and prevention, and entry the final signals for activation passive and active measures of protection and defense.

The architectural design of ultrasound processing hardware is being determined basically by use of different ultrasound intrusion detection techniques in each echelon. These techniques are based on the different modes of ultrasound signals' responses (i.e. reflection, refraction by edge diffraction and interference by shadowing). The architectural design of this hardware is being additionally defined by the chosen modes of intrusion monitoring inside every echelon with stationary vectoring or continuous scanning of all the ultrasonic receivers, by the optional utilization of Doppler detection technique, and by the optional customized use of the automatic adjustment of emitting-receiving frequency regarding running changes in the ambient air conditions. Thus, there is the evident necessity to minimize the diversity of all hardware and software being utilized in echelons C, S and L in assortment and power consumption. This minimization is suggested done in the steps of:

- graphical matching of frontiers of juxtaposed echelons for elimination of dead spots of ultrasound detection, and graphical prototyping of overlapping the protected areas of echelons C, S and L completely with beam patterns of chosen transceivers, transducers and receivers; and
- conjugation of specification figures of various ultrasound instruments involved, at least such as center operating frequency and bandwidth of ultrasound emission, S/N ratio, and type of signal processing domain, which specification figures are destined for practicing different modes of response of ultrasound beam patterns, including reflection, refraction by edge diffraction, and interference with shadowing the emitted beam pattern by a target; and
- unification of instrumentation for different modes of intrusion monitoring inside every echelon with stationary vectoring or continuous scanning of all the ultrasonic receivers, for the optional utilization of Doppler detection technique, and for the technique of the automatic emitting-receiving frequency adjustment under running changes in the ambient air conditions.

The aim of the innovative approach of the present invention is to enhance the distance of ultrasound intrusion monitoring due to the multi-level arrangement of ultrasound surveying network of transducers and receivers that enables long-range ultrasound locating in spite of its intensive attenuation in the ambient air. It permits to meet the requirements of functional diversity and operational reliability in various redundant trains of reliable defense-in-depth safety systems.

Therefore, the method and arrangement of effective and stealthy ultrasound intrusion detection according to the present invention are of the evident necessity for protection of Nuclear Power Plants, refineries, offshore rigs, flowing plants of gas-main pipeline, and other civilian and military objects that feature complex spatial component layout.

The present invention is not to be confined to the precise details herein shown and described, nevertheless changes and modifications may be made so far as such changes and modifications indicate no significant deviation from the sense and art of the claims attached hereto.

What is claimed as new and desired being secured by Letter Patent of the United States is:

1. A method of defense-in-depth ultrasound intrusion detection that provides for sufficient enhancement of the distance of location and detection of an intruder with airborne ultrasound throughout enclosed premises of buildings, near field zone and circumjacent air vicinity of a dome-type, volumetric room that surrounds a protected object, including the techniques of:

arrangement of the volumetric room into geometrically closed areas that constitute a spatial multi-echelon infrastructure of a defense-in-depth automatic intrusion protection system; and commissioning each of single-level or multi-sublevel echelons of intrusion detection wherein: a central indoor echelon (C) containing the enclosed premises of a protected object is being commissioned to detect an intruder's presence and direction of ingress or egress motion; an outdoor short-range echelon (S) of the near field zone adjoining the buildings, works and installations of a protected object is assigned to detect the presence and locality of an intruder relating to the direction of the intruder's motion; an outdoor long-range echelon (L) of a circumjacent air vicinity of a layout area of a protected object detects of the intruder's presence, and speed and direction of the intruder's motion; and rating the size of each particular echelon in the designed prevailing direction of intrusion location distance that should not exceed the distance at which an airborne ultrasound wave attenuates along its incidence and reflection trip to the value less than the dead band of ultrasonic transceivers where said transceivers are being chosen regarding their operating frequency and prognosticated conditions of ambient air around a protected object; and application of different modes of response of an emitted ultrasound signal, at least the reflection, refraction by edge diffraction and interference with shadowing by an intruded target, in accordance with a procedure of intrusion detection and presumptive spatio-temporal conditions of intrusion location in every echelon; and designing predictive models of intrusion vulnerability of each echelon and the entire area of the protected object regarding previously simulated model of presumptive spatio-temporal behavior of an intruding object along their possible routings; and plotting an intrusion event tree that reveals cause-effect relations between an intrusion occurrence and subsequent menaces, to echelons and their sublevels therein, and to a protected object integrally where for simple arrangements of ultrasonic intrusion detection systems three or less echelons, each comprising separate sublevels with single units of protected equipment, the event tree is composed with use of techniques of combinations and situational logic transition, whereas for the arrangement of more than three echelons with a plurality of protected units of equipment installed in each echelon or in its sublevels; the event tree is composed on the basis of complete Markov models with Boolean transition logic; and derivation of mathematical expressions of logical equations of said cause-effect relations for the intrusion events in every echelon and its sublevels therein, a verifying logical matrix of intrusion justification, a logical decision matrix of inter-echelon cause-effect relations and factors of menaces, a generalized resolving logical equation; and drawing up control software algorithm for governing at least: a resolver, which handles the system of said echelon's logical equations, the verifying logical matrix, the logical decision matrix and the generalized resolving logical equation; data control block that operates modes of locating with ultrasound beams and a data acquisition procedure; and system control block that forms and presents signals of intrusion detection and justification, and triggering signals of intrusion prevention, protection and defense; and establishing a software-programmable inter-echelon informational and processing logical interrelation among all the juxtaposed and non-adjacent echelons wherein said interrelation is automatically treated and handled in a real time domain by said control software algorithm that operates a continuous status scan of all the ultrasonic transceivers and oppositely aligned pairs of transmitters and receivers in every echelon simultaneously; and which algorithm provides for:

transferring the data of continuous status scan to the echelons' logical equations, verifying logical matrix, and logical decision matrix;

ability of said resolver to process acquired data by said echelons' logical equations, verifying logical matrix, logical decision matrix and generalized resolving logical equation up to the final decision of the goal function of the intrusion detection and protection method; and creation and presentation of logically true sequence of caution and self-checking signals for every intrusion-suspected echelon, signal of intrusion vindication for the affected echelon, and final triggering signals of alarm and activation of security measures where the creation and presentation of the final triggering signals; and entry of triggering signals for starting security measures of active and passive protection and defense, which measures include at least: activation of an alarm system, enclosing movable physical barriers around the protected works and installations, hence entrapping an intruding object inside echelon C, application of disabling tear gas, involving guard troops, deploying inflatable air obstacles in echelons S and L or opening defensive fire in echelon L.

2. The method as defined in claim 1 wherein a protected dome-type volumetric room around a critical object is arranged in several juxtaposed echelons; where the indoor single-level or multi-sublevel echelon C is arranged inside the enclosed premises of a protected object, in each of which at least a transmitter and receiver pair is mounted for inward detection of an intruder by the ultrasound beams responding in reflection or refraction by diffraction modes; and where the outdoor single-level or multi-sublevel echelon S of the near field zone adjoining the buildings and installations of a protected object is being shaped to consist of 2-D polygonal or curvilinear plane contours, or 3-D curved surface areas that are connected into a spatial solid openwork frame, equipped with pairs of oppositely directed transmitters and receivers, so that the near field zone has been covered by closely adjacent or overlapped ultrasound beam patterns, which are designated to respond either in the refraction mode characterized with diffraction of receiver's beam pattern by intruder's edge, or in the mode of interference featured shadowing a receiver's beam pattern by an intruding object; and further where the single-level or multi-sublevel echelon L of the circumjacent air vicinity of the layout area of a protected object is shaped into 3-D curved surface in the form of spatial lattice equipped with outwardly directed transceivers that function by techniques of constant vectoring or scanning solid angles that overlap each other, and operate in the mode of continuous emission of ultrasound beams and occasional reception of ultrasound beams reflected from a target.

3. The method as defined in claim 2, including the steps of:

shaping inner boundaries of outdoor single-level or multi-sublevel echelon S of the near field zone in compliance with layout and overground contours of installations and works of a protected object, while shaping the outer frontiers of the echelon S in compliance with layout and outside contours of prohibited areas and access roads around works and buildings of a protected object; and division of the outdoor echelon S of the near field zone into separate sublevels and designing the geometrical shapes and dimensions of said 2-D polygonal or curvilinear contours, or 3-D curved surface areas in accordance with:

spatio-temporal parameters of airborne ultrasound propagation towards previously designed prevailing directions of ultrasonic location in forecasted conditions of the air ambient, while admitting the airborne ultrasound wave attenuation along its one-way emission trip from a transmitter to the opposite receiver to have occurred to the value not less than the dead band of ultrasonic transceivers;

the presumptive spatio-temporal behavior of the intruding object over the terrain of the echelon S of a protected object regarding their possible routings;

covering said surfaces areas with the ultrasound beam patterns chosen regarding conditions of ultrasound propagation and applied either in stationary or scanning modes of surveillance; and shaping the echelon L of circumjacent air vicinity of the layout area of a protected object so that it is open outwardly to the dome-type room whereas the inside geometrically closed frontier of echelon L is configured as the openwork spatial lattice, enveloping the external frontier of the outdoor echelon S, otherwise said both frontiers are constructed to coincide in part or in full.

4. The method as defined in claims 1 or 3, including the steps of:

composing the graphic-analytical model of intrusion vulnerability for each echelon regarding different situations of spatio-temporal behavior of the intruding object along their possible routing inside premises of the central echelon C, around buildings and works of short-range echelon S, within reach of ultrasound location inside the space of the long-range echelon L, where ingress or egress routings thru every echelon are searched according to the layout and architectural features of the available protective barriers against an intrusion, and various assumed ways of the intruder's accessibility to the works and installations therein; and verification of geometrical shape and dimensions of every echelon with respect to its predictive graphic-analytical model of intrusion vulnerability where said verification is accomplished by comparison of spatio-temporal parameters of intruder's behavior with spatio-temporal parameters of ultrasound beams' propagation and signaling response in the previously prevailing directions of location.

5. The method as defined in claims 1 or 2 wherein the technique of ultrasound intrusion detection for each of said echelons is being chosen in the steps of:

selection of modes of ultrasonic beam response regarding commissioning of every echelon and in compliance with previously composed predictive graphic-analytical models of intrusion vulnerability for each echelon; and definition of an erection diagram for disposition of ultrasound transceivers installed inside premises of the echelon C and mounted along the circumference of the echelon L, and for arrangement of the oppositely aligned pairs of transmitters and receivers along either adverse sides of the integral contour of single-level echelon S or adverse sides of the joining contours of juxtaposed portions of multi-sublevel echelon S where said disposition and arrangement are schematized in the form of straight-line or elbow-type rows, planar array or in the spatial lattice for each of said echelons with respect to said predictive echelons'graphic-analytical models of intrusion vulnerability and with requirements to close and overlap coverage of at least possible routings of intruding objects with ultrasound beam patterns operating in stationary or in scanning mode of location.

6. The method as defined in claims 1 or 4 wherein a generalized graphic-analytical model of intrusion vulnerability for an entire protected dome-type volumetric room around a critical object is composed, including the steps of:

designation of available stationary and movable physical barriers for prevention of the intruding object to the installations and works definition of territorial contours and limits of operating time, where non-authorized presence or movement of an intruding object is considered as violation of access mode and an actual hazardous intrusion; and plotting the intrusion event tree in the form of graphic representation or table matrices which identify the interrelations of sublevels inside any echelon, and among juxtaposed or non-adjacent echelons that are based on the sequence of the cause-effect events of an intrusion occurrence and definition of the menaces that appear due to the presence and motion of the intruding object, where the graphic presentation of the intrusion event tree is fulfilled on floor plans of enclosed premises of echelon C and on the lay-out of the near field zone of echelon S for detection of intrusion cause-effect cross-linkages of intrusion menaces among sublevels inside echelons, and among juxtaposed and non-adjacent echelons C, S and L; and where the revealed data of said cross-linkages of intrusion menaces are used for setting up and analysis of said logical decision matrix, and for setting up said generalized resolving logical equation; and further setting up the generalized graphic-analytical model in the form of graphic-and-analytical representation of inter-echelon dependable vulnerability at occurrence of one or more intrusions in one or all of the echelons, where the analytical part of graphic-and-analytical representation is set with use of the situational logic transition.

7. The method as defined in claims 1 or 4 or 6 wherein the echelons' logical equations are set up in advance to reveal the menaces inside the echelons and sublevels therein based on said graphic-analytical models of intrusion vulnerability that is estimated by probable cause-effect damages of protected facilities and sequential losses rated on the basis of single-failure criterion, especially of the installations, belonging to some sublevels in one echelon or to different echelons concurrently; where the logical decision matrix of the control software algorithm is designed by placing top-down into echelons and their main column all the sublevels in the order of defense-in-depth structure, beginning from echelon L, and further by arranging factors of menaces, drawn from said echelons' logical equations, in the rows against the respective echelons and their sublevels in the order of diminishing rate of said factors of menaces; where the verifying logical matrix is designed for carrying out logic analysis for integrity of inter-echelon caution and self-checking signals for resolution of the goal function by the generalized resolving logical equation of the control software algorithm; and where said generalized resolving logical equation is set up in the result of the analysis of logical decision matrix and generalized graphic-analytical model of intrusion vulnerability with regard to the intrusion cause-effect cross-linkages among sublevels inside echelons, and among juxtaposed and non-adjacent echelons C, S and L.

8. The method as defined in claims 1 or 7 wherein the goal function of ultrasound intrusion detection is iteratively resolved during continuous status scan and data acquisition in the steps of:

solution of the echelons' logical equations for justification of intrusion menace; and carrying-out running analysis of acquired facts of intrusion menaces by logical decision matrix; and processing the generalized resolving logical equation by said control software algorithm with respect to the verifying logical matrix.

* * * * *